US007231988B2

(12) United States Patent
Jerg et al.

(10) Patent No.: US 7,231,988 B2
(45) Date of Patent: Jun. 19, 2007

(54) FIRE PROTECTION DEVICE FOR DOMESTIC APPLIANCES

(75) Inventors: Helmut Jerg, Giengen (DE); Stefan A. Staedel, Ingolstadt (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 279 days.

(21) Appl. No.: 10/739,625

(22) Filed: Dec. 18, 2003

(65) Prior Publication Data

US 2004/0194978 A1 Oct. 7, 2004

Related U.S. Application Data

(63) Continuation of application No. PCT/EP02/06517, filed on Jun. 13, 2002.

(51) Int. Cl.

| | |
|---|---|
| ***A62C 37/10*** | (2006.01) |
| ***A62C 37/00*** | (2006.01) |
| ***A62C 3/00*** | (2006.01) |
| ***A62C 3/16*** | (2006.01) |
| ***D06F 39/08*** | (2006.01) |

(52) U.S. Cl. ..... 169/60; 169/56; 169/61; 137/312

(58) Field of Classification Search ..... 169/60, 169/56, 61, 54, 65; 137/312
See application file for complete search history.

(56) References Cited

U.S. PATENT DOCUMENTS

| | | | | |
|---|---|---|---|---|
| 3,866,687 | A * | 2/1975 | Banner | 169/61 |
| 4,805,662 | A * | 2/1989 | Moody | 137/312 |
| 4,830,116 | A * | 5/1989 | Walden et al. | 169/65 |
| 4,979,572 | A * | 12/1990 | Mikulec | 169/65 |
| 4,987,408 | A * | 1/1991 | Barron | 340/604 |
| 5,428,347 | A * | 6/1995 | Barron | 340/604 |
| 5,936,531 | A * | 8/1999 | Powers | 340/628 |
| 6,029,751 | A * | 2/2000 | Ford et al. | 169/60 |
| 6,648,077 | B2 * | 11/2003 | Hoffman | 169/56 |
| 6,655,047 | B2 * | 12/2003 | Miller, II | 34/544 |

FOREIGN PATENT DOCUMENTS

| | | |
|---|---|---|
| GB | 2205037 | * 11/1988 |

* cited by examiner

*Primary Examiner*—Frederick C. Nicolas
*Assistant Examiner*—Darren Gorman
(74) *Attorney, Agent, or Firm*—Russell W. Warnock; Craig J. Loest

(57) ABSTRACT

A fire protection and extinguishing device for a water-conducting domestic appliance. When a malfunction occurs that in the appliance that could potentially result in a fire, the device protects the appliance from further damage, prevents the danger of a fire starting and can extinguish a fire, which has already started. The device includes a fault current circuit breaker, which will disconnect the electric supply to the appliance, when a fault current occurs. The device further includes a gas sensor and a water sprinkler, which will disconnect the electric supply to the appliance and activate the water sprinkler, when a specific amount of control gas occurs in the appliance.

9 Claims, 2 Drawing Sheets

FIRE PROTECTION DEVICE FOR DOMESTIC APPLIANCES

The present invention relates to a fire protection and fire extinguishing device for aquiferous domestic appliances.

Domestic appliances, which have several power consumers, such as for example motors, heaters etc., are usually not subjected to individual checks on their electrical safety. In order to avoid damage to the domestic appliances, as a result of excess current, domestic appliances generally have safety devices, which have for example a safety button made of porcelain or ceramic, which glows when a specific current strength is reached and thus protects the domestic appliance from further damage, in particular smouldering fires or the like.

Because ignitable and inflammable materials are used in the manufacture of electrical appliances for the household, there may be a heightened risk that these materials catch fire in the event of a short circuit or when electric wires wear through. DE 38 09 754 A1 discloses a device with a container for a fire retardant substance for extinguishing such fires, which container opens automatically in the presence of a flame or when the ambient temperature rises above a limit parameter, for the purpose of pouring the fire retardant substance indirectly or directly onto the parts of the appliance endangered by fire or which are to be protected therefrom. In this case an arrangement can be made where the containers, preferably several of them, in each case have cells containing fire retardant substance and which effectively have boreholes in the floor region, which are occluded by a protective film or a membranous skin, for example, which bursts at a preset temperature to open up the boreholes and in the process let the fire retardant substance escape.

It has proven advantageous with this device that the bores open only at a specific temperature, that is, when certain temperatures are reached which melt the membrane covering the bores. For this melting procedure, however, it is necessary for a sufficiently high temperature to be transferred via air, so that a very much higher temperature must already prevail on the Brandherd and as a result only then does the extinguishing commence, by which time a certain degree of destruction has already occurred.

Also, compared to the destruction of several domestic appliances, in the kitchen for example, when the loss of a single domestic appliance proves to be comparatively low, it is all the same desirable to protect this electrical appliance from total damage, as far as possible. But because the device disclosed in DE 38 09 754 A1 comes into play only when the electrics are already partially destroyed, substantial damage has already occurred in this appliance.

The object of the present invention is therefore to provide a fire protection and fire extinguishing device for domestic appliances, which right at the outset of a malfunction which could potentially result in the domestic appliance catching fire, carries out measures which can protect the domestic appliance from further damage, prevent the danger of fire and indeed extinguish any existing fire.

According to the present invention this task is solved by a fire protection and fire extinguishing device having the features specified in claim 1. Advantageous configurations of the present invention are specified in the sub-claims.

With the fire protection and fire extinguishing device for aquiferous domestic appliances according to the present invention the spread of a smouldering fire, caused by electrical failures, is prevented, since gases resulting from smouldering are detected by the gas sensor, and a signal is generated when a certain quantity of control gas, for example carbon monoxide (CO) and/or chlorine (CI), is present inside the domestic appliance, which results in disconnection of the electricity supply inside the domestic appliance, as well as activation of a water sprinkler system for extinguishing fire inside the domestic appliance.

Apart from the gas sensor at least one fault current circuit breaker is also put in place, which initiates a, preferably all-pole, disconnection of the electricity supply of the domestic appliance as soon as a fault current occurs in one of the electrical conductors in the domestic appliance, and thus for example prevents heating and igniting of synthetic materials.

Advantageously the fault current circuit breaker is integrated into the mains plug of the domestic appliance, such that the size of the mains plug is only slightly larger than a standard mains plug. Yet it can prove effective to arrange the fault current circuit breaker in the domestic appliance such that it fulfils a function of main switch, that is, the domestic appliance can be switched on and off by way of the fault current circuit breaker. This compact construction enables the fire protection device according to the present invention to be divided into three chief components, consisting of a special gas sensor technology in the floor region or in the door of the domestic appliance, a special mains plug, or main switch and electric conductors, which take on the additional function of, preferably all-pole, disconnection of the domestic appliance, and also comprising a water sprinkler system for extinguishing existing fires in the domestic appliance.

With the fire protection and fire extinguishing device for aquiferous domestic appliances according to the present invention it eventuates that a fault current, smouldering, an open fire or smoke is recognised and the aquiferous domestic appliance is cut off promptly from the mains supply, and on the one hand any spread of malfunctions is prevented, or the very occurrence of malfunctions is prevented, and on the other hand the electric ignition energy for the fire or the smouldering is stopped. If a fire does break out the water sprinkler system is activated for the purpose of extinguishing fires by means of a spray mist, for example.

When the fire protection and fire extinguishing device for domestic appliances according to the present invention is used fault currents or short circuits in the appliance are already recognised in a first safety step, before they can result in an outbreak of smouldering or open fire caused thereby. In a second step furthermore, the onset of smoke, attributable essentially to polyethylene (PE), polypropylene (PP), polyamide (PA), polyvinyl chloride (PVC) or polystyrol (PS), is detected early enough by the gas sensor, since carbon monoxide (CO) and/or chlorine (CI) is released when these synthetic substances combust. When the mains is disconnected leak currents can be prevented from skipping from or to adjacent electrical appliances, which are situated in the same current circuit. In a third step the water sprinkler system is activated and generates a spray mist or the like, for example, inside the aquiferous domestic appliance. To prevent likewise unwanted damage caused by water, which might occur as a result of the spray mist, the aquiferous domestic appliance has a base pan which registers any rise in the water trapped in the base pan by means of a float element and then blocks the water supply to the water sprinkler system as soon as a preset level is reached. The present invention provides a fire protection and fire extinguishing device for domestic appliances, which, at the outset of a malfunction which could potentially result in the domestic appliance catching fire, carries out measures both to protect the domestic appliance from further damage, and prevent the danger of fire, as well as extinguish an existing fire.

Advantageously the main switch of the electrically operated domestic appliance, which is used to supply the individual components of the domestic appliance, is connected to the mains plug, whereby the main switch is supplied only with low voltage. With the fire protection device according to the present invention it is guaranteed that essential electric currents running in the interior of the domestic appliance are provided as low voltage, with the exception of electric currents for e.g. motors and heaters. Via the fire protection device according to the present invention advantageously no electric conductor with alternating current of 230 V is guided through the domestic appliance as far as the main circuit.

Advantageously the gas sensor is arranged in the floor region and/or a door of the domestic appliance. The signal for switching on, switching off or disconnection of the domestic appliance by means of a fault current circuit breaker can be given via direct connection (conductor/flexible cord), as radio signal or also via an appliance-internal or appliance-external bus. The gas sensor circuit compares the accumulated actual values to the detected parameters and triggers a disconnection signal in the event of sufficient deviation. This signal results in, preferably all-pole, disconnection of the domestic appliance.

The fire protection and fire extinguishing device according to the present invention will be explained hereinbelow in greater detail with reference to preferred embodiments, in which.

The fire protection and fire extinguishing device for aquiferous domestic appliances according to the present invention will be explained hereinbelow in terms of an embodiment of a dishwashing machine 2.

Figure 1:
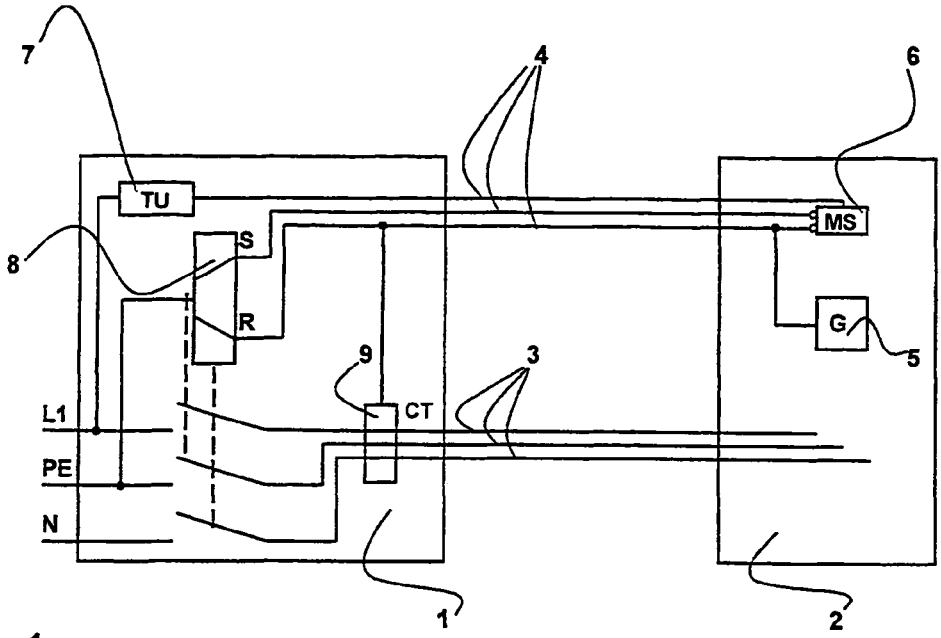
FIG. 1 shows a circuit plan of a mains plug, its fire protection device according to the present invention without extinguishing device, as well as a schematic diagram of the domestic appliance.

The fire protection and fire extinguishing device according to the present invention with a circuit plan as in FIG. 1 shows a mains plug 1, which is connected to the dishwashing machine 2 via electric conductor bundles 3 and 4. The conductor bundles 3 lead from the mains plug 1 to the electrical consumers, such as for example motors or heaters, the conductor bundles 4 lead from the mains plug 1 to the main switch, which can e.g. be designed as four-way operation buttons. The conductor bundles 4 are configured as low voltage conductors. Arranged in the floor region of the dishwashing machine 2 in the illustrated embodiments is a gas sensor 5, assigned to which is a gas sensor circuit, and is connected by way of electric conductors to the main switch 6, so that when a signal of the gas sensor 5 is emitted the main switch 6 interrupts the main current circuit and the dishwashing machine 2 is them without current. Provided in the mains plug 1 is a transformer unit 7, which transforms incoming 230 V alternating current to a low voltage via flexible cord L1. In addition, a relay 8, in the embodiments a bistable relay 8, is provided in the mains plug 1, which is connected via both channels R and S to the main switch 6. With the signal induced by the main switch 6 to channel S the relay 8 closes and switches on the dishwashing machine 2, and with the signal to channel R opens the relay 8 and disconnects the dishwashing machine 2. Located in the main current circuit, which is built up essentially by the conductor bundles 3, is a cumulative current transformer 9, which constantly measures the sum of all currents and from a certain deviation, which is attributable for example to a fault current, sends a signal to the reset inlet—channel R—of the relay 8, so that finally the main switch 6 of the dishwashing machine 2 disconnects.

Figure 2:
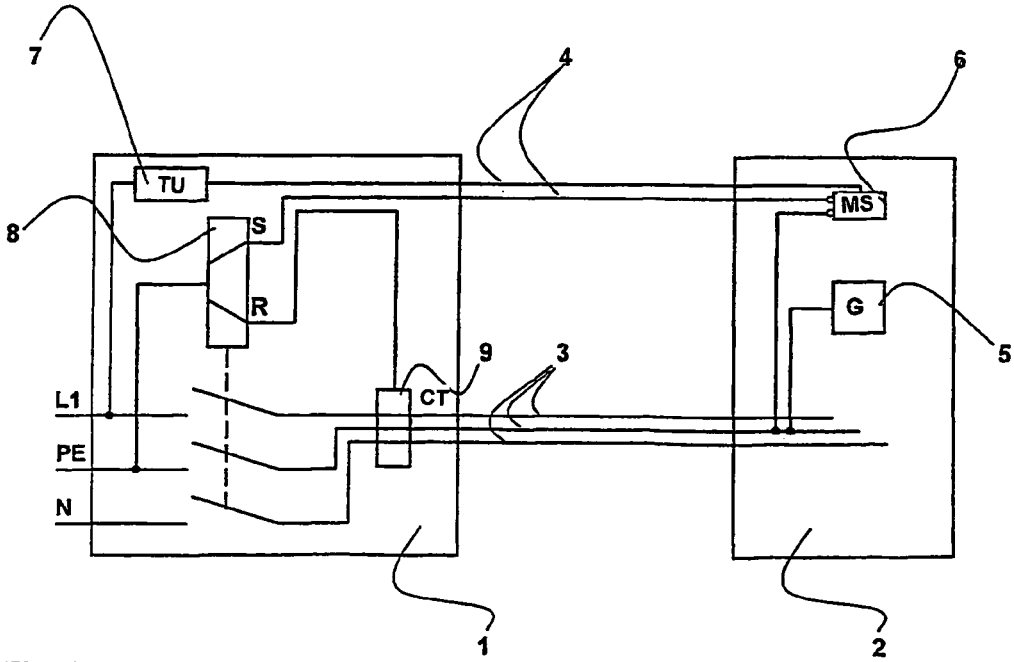
FIG. 2 shows another preferred embodiment of the fire protection device according to the present invention and its fire protection device without extinguishing device.

With the fire protection and fire extinguishing device according to the present invention with a circuit plan according to FIG. 2 the same components are designated as in the circuit plan in FIG. 1. A technical variant comprises placing the gas sensor 5 and the main switch 6 not directly in the reset channel of the relay 8, but rather to guide both conductors via the protective conductor PE. The technical features, in particular the performance features of the circuit as per FIG. 2, are identical to the performance features of the circuit as in FIG. 1.

Figure 3:
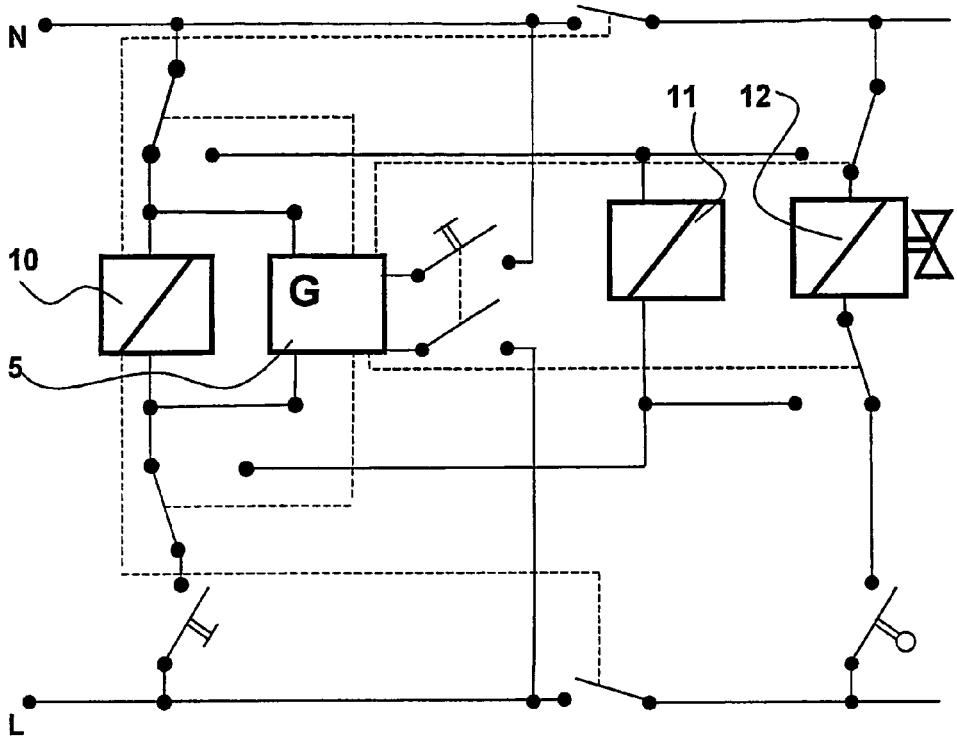
FIG. 3 shows a circuit plan of a fire protection and extinguishing device with extinguishing device.
Figure 4:
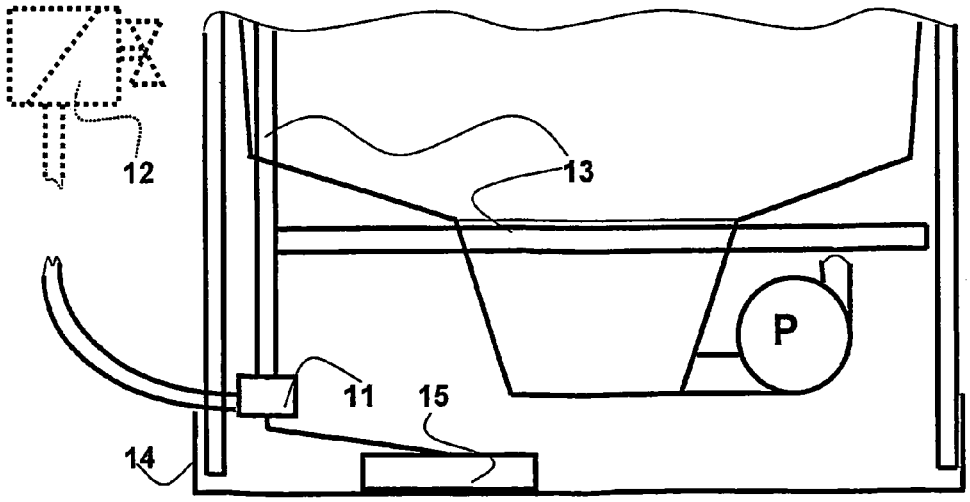
FIG. 4 shows a schematic diagram of the fire protection and fire extinguishing device according to the present invention as in FIG. 3.

In the arrangement according to FIGS. 3 and 4, which can be switched as per the relay 8 of the abovedescribed embodiments according to FIG. 1 and FIG. 2 and which is connected to the gas sensor 5 with gas sensor circuit, the electric supply of the aquiferous domestic appliance 2 is controlled via a relay 10. The relay 10 is activated byresponse from the gas sensor 5, so that all components of the domestic appliance 2 are cut off from the mains supply. As an alternative to the illustrated circuit in this particular embodiment the on and off switch function can be performed by a fault current circuit breaker, as described for in FIGS. 1 and 2. At the same time a reversing valve 11 is actuated, so that water can flow into a loop line 13. The loop line 13 is arranged advantageously in the interior of the domestic appliance such that all combustible material can be wetted by a generated spray mist.

The loop line 13 is designed effectively as an inflammable line and is guided to all endangered components, whereby nozzles are provided in the loop line 13 at the critical sites through which water or a water mist can escape. Water is sprayed through the loop line 13 until such time as a preset switch level is reached in the base pan 14 (see FIG. 4) and a float 15 positioned therein blocks off a shut-off valve 12, which regulates the water supply to the domestic appliance, (indicated in FIG. 4 by dotted lines). In a particularly advantgeous way units such a pumps P, heaters or heat exchangers etc. are arranged above the preset switch level in order to keep possible water damage to the possible minimum.

The invention provides a fire protection and fire extinguishing device for an aquiferous domestic appliance 2, which carries out measures at the outset of a malfunction with potential fire consequences for the domestic appliance 2, in order both to protect the domestic appliance 2 from further damage, and to prevent the danger of fire, as well as extinguish an existing fire.

The invention claimed is:

1. A fire protection and fire extinguishing device for aquiferous domestic appliances, comprising:

at least one fault current circuit breaker coupled to the input electrical supply of at least one conductor of a domestic appliance that has a water supply arrangement for supplying water to the domestic appliance such that the domestic appliance can perform an aquiferous operation on items being handled by the domestic appliance, which fault current circuit breaker disconnects said electrical supply from said appliance when said fault current circuit breaker senses a fault current in said at least one conductor;

at least one gas sensor coupled to sense the quantity of at least one control gas in said appliance, which gas sensor also causes said electrical supply to be disconnected from said appliance when said gas sensor senses a predetermined quantity of said at least one control gas; and at least one water sprinkler system having a loop line for providing a spray mist to said appliance when said electrical supply is disconnected from said appliance by said gas sensor, the loop line being connected to the water supply arrangement of the domestic appliance for receiving water therefrom.

2. The fire protection and fire extinguishing device according to claim 1, including said fault current circuit breaker integrated into a mains plug of said electrical supply of said appliance.

3. The fire protection and fire extinguishing device according to claim 2, including a main switch for supplying individual components of said domestic appliance is coupled to said mains plug for supplying low voltage to said components.

4. The fire protection and fire extinguishing device according to claim 3, including said gas sensor is connected to said fault current circuit breaker.

5. The fire protection and fire extinguishing device according to claim 3, including said gas sensor is connected to a protective conductor and said fault current circuit breaker is triggered at a predetermined concentration of said control gas.

6. The fire protection and fire extinguishing device according to claim 3, including said main switch is connected to a protective conductor.

7. The fire protection and fire extinguishing device according to claim 1, including said fault current circuit breaker acts as a main switch for said domestic appliance.

8. The fire protection and fire extinguishing device according to claim 1, including said gas sensor is located in a door of said domestic appliance.

9. The fire protection and fire extinguishing device according to claim 1, including said appliance including a plurality of conductors, said fault current circuit breaker coupled to each of said conductors and a fault current detected in one of said conductors, causes said fault current circuit breaker to disconnect said electrical supply from said appliance by an all-pole disconnection and said gas sensor also disconnects said electrical supply from said appliance by an all-pole disconnection.

* * * * *

UNITED STATES PATENT AND TRADEMARK OFFICE

CERTIFICATE OF CORRECTION

PATENT NO. : 7,231,988 B2
APPLICATION NO. : 10/739625
DATED : June 19, 2007
INVENTOR(S) : Jerg et al.

It is certified that error appears in the above-identified patent and that said Letters Patent is hereby corrected as shown below:

On the title page

Item 30 Foreign Application Priority Data

Please add

June 26, 2001 (DE) ..... 101 30 607.5

Signed and Sealed this

Seventh Day of August, 2007

JON W. DUDAS
*Director of the United States Patent and Trademark Office*